United States Patent [19]

Jubb et al.

[11] Patent Number: 4,869,317

[45] Date of Patent: Sep. 26, 1989

[54] HEAT EXCHANGER

[75] Inventors: Albert Jubb, Kenilworth; Robert G. Ward, Coventry; Eric W. Stansbury, Kenilworth, all of England

[73] Assignee: Rolls-Royce plc, London, England

[21] Appl. No.: 254,040

[22] Filed: Oct. 6, 1988

[30] Foreign Application Priority Data

Oct. 20, 1987 [GB] United Kingdom ..... 8724535

[51] Int. Cl.[4] ..... F28F 3/08

[52] U.S. Cl. ..... 165/166; 165/167; 165/174

[58] Field of Search ..... 165/166, 167, 174

[56] References Cited

U.S. PATENT DOCUMENTS 3,157,229 11/1964 Wennerberg ..... 165/167

3,807,496 4/1974 Stadmark ..... 165/167

3,817,324 6/1974 Andersson ..... 165/167

4,270,602 6/1981 Foster ..... 165/167

*Primary Examiner*—Martin P. Schwadron

*Assistant Examiner*—Allen J. Flanigan

*Attorney, Agent, or Firm*—Cushman, Darby & Cushman

[57] ABSTRACT

A heat exchanger comprises a matrix made up of alternate layers of generally planar sheets and generally corrugated sheets which cooperate to define a plurality of parallel passages for first and second heat exchange fluids. Alternate of the passages defined by each of the corrugated sheets and its adjacent planar sheets are adapted for the passage of a first heat exchange fluid and the remainder adapted for the passage of a second heat exchange fluid. The ony bonding together of the planar sheets and corrugated sheets is along those portions of their peripheries which are parallel with the defined passages.

9 Claims, 4 Drawing Sheets

HEAT EXCHANGER

This invention relates to heat exchangers and in particular to compact heat exchangers which are capable of withstanding high thermal gradients.

A well known form of compact heat exchanger is commonly known as the "plate-fin" type. Such heat exchangers comprise a matrix defined by a stack of sheets of corrugated metallic material, each of which is separated from its adjacent sheet by a plane sheet of metallic material. The corrugated and plane sheets are brazed together so that one corrugated sheet and two parallel sheets cooperate to define a plurality of parallel passages for the flow of heat exchange fluid. Alternate corrugated sheets are disposed at right angles to each other so that alternate defined passages are correspondingly disposed at right angles to each other. This facilitates the passage of a first heat exchange fluid through alternate defined passages and a second heat exchange fluid through the remaining passages. Such an arrangement facilitates the location of suitable manifolds for the first and second heat exchange fluids at the edges of the matrix.

Such forms of heat exchanger construction suffer from drawbacks which limit their use in certain applications. More specifically, since the first and second heat exchange fluids flow in directions which are perpendicular to each other, the degree of heat exchange between them is not as great as would be the case with a truly contra-flow heat exchanger. A further difficulty lies in the bonding of the corrugated sheets to the plane sheets. If there is a large temperature difference between the first and second heat exchanger fluids, the resultant large thermal gradients in the rigid heat exchanger matrix could give rise to undesirable cracking or braze failure. Moreover, if such cracking or braze failure should occur, great difficulty would be encountered in effecting a repair since a lot of brazed joints would have to be broken to provide access to the defective part of the matrix.

It is an object of the present invention to provide an improved form of heat exchanger in which such difficulties are substantially avoided.

According to the present invention, a heat exchanger comprises a matrix defined by a stack of alternate layers of generally planar sheet material and sheet material of generally corrugated form which cooperate to define a plurality of generally parallel passages, alternate of said passages defined by each of said generally corrugated sheets and its adjacent generally planar sheets being adapted for the passage of a first heat exchange fluid therethrough, the remainder of said passages being adapted for the passage of a second heat exchange fluid therethrough, said passages for the passage of said first heat exchange fluid being so adapted as to prevent any physical contact between said first and second heat exchange fluids, first manifold means being provided and so adapted as to operationally direct said first heat exchanger fluid into each of said passages adapted for the passage of said first heat exchange fluid therethrough and second manifold means being provided and so adapted as to operationally exhaust said first heat exchange fluid from each of said passages adapted for the passage of said first heat exchanger fluid therethrough.

The invention will now be described by way of example, with reference to the accompanying drawings in which.

Figure 1:
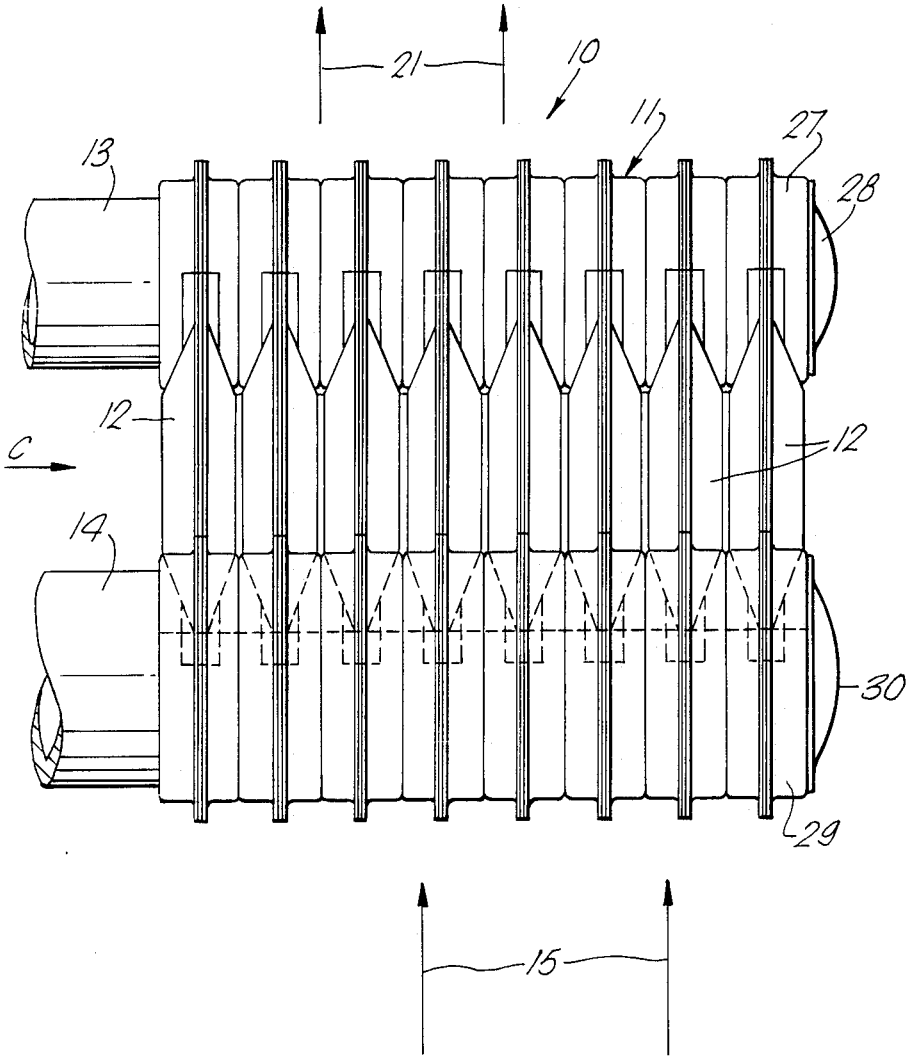
FIG. 1 is a general view of a heat exchanger in accordance with the present invention.
Figure 2:
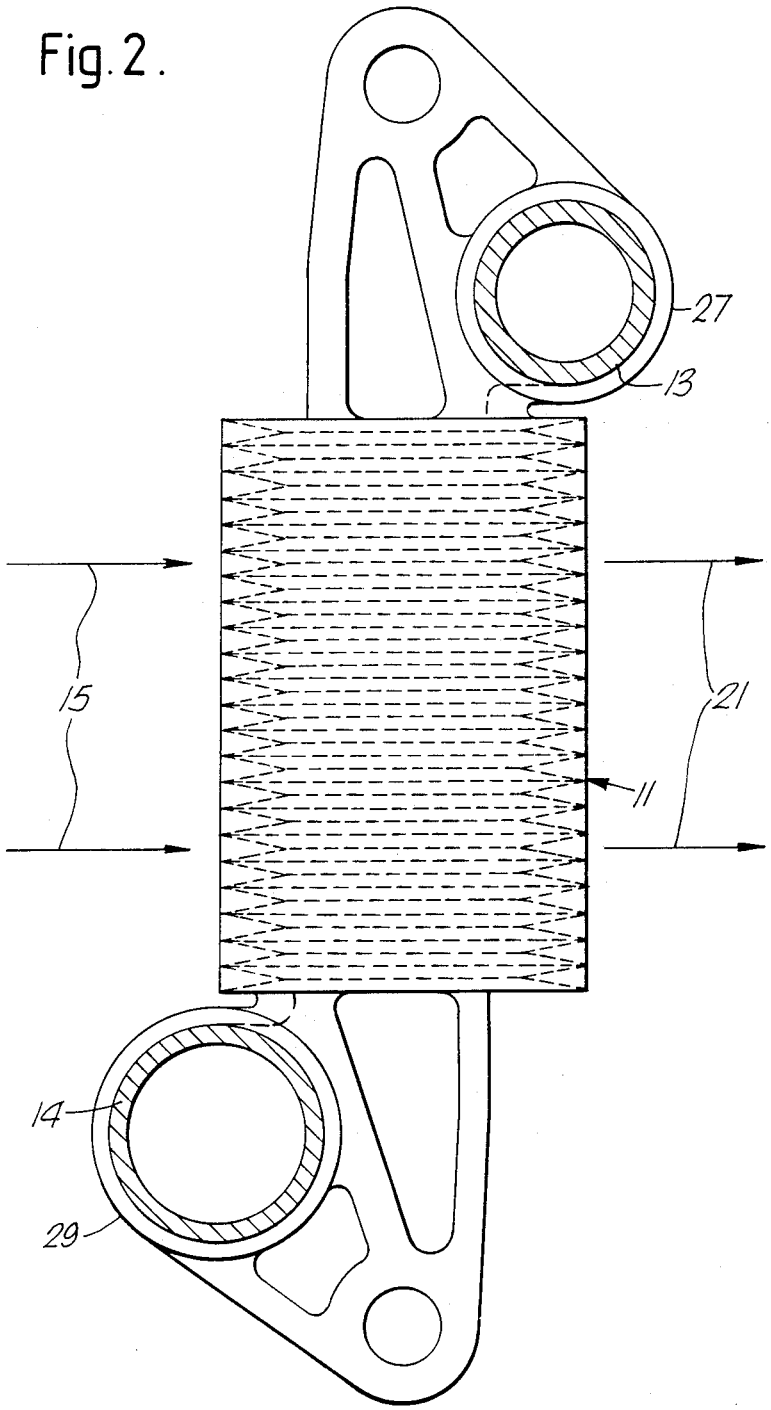
FIG. 2 is a view on arrow C of FIG. 1.

With reference to FIG. 1, a heat exchanger generally indicated at 10 comprises a matrix 11 which is made up of a number of similar modules 12 which are brazed together. The heat exchanger 10 is adapted to place two fluids in heat exchange relationship with each other. The first heat exchange fluid, which may for instance be air which has been compressed and is intended for combustion in a gas turbine engine, enters the heat exchanger 10 via a conduit 13 and exhausts from the heat exchanger 10 via a further conduit 14. The second heat exchange fluid, which may for instance be the hot exhaust efflux of a gas turbine engine, flows in the direction indicated by the arrows 15 to pass through the heat exchanger matrix 11, and exhausts therefrom in the direction indicated by the arrows 21. As can be seen from FIG. 2, the inlet and exhaust conduits 13 and 14 for the first heat exchange fluid are situated on opposite sides of the matrix 11.

Figure 3:
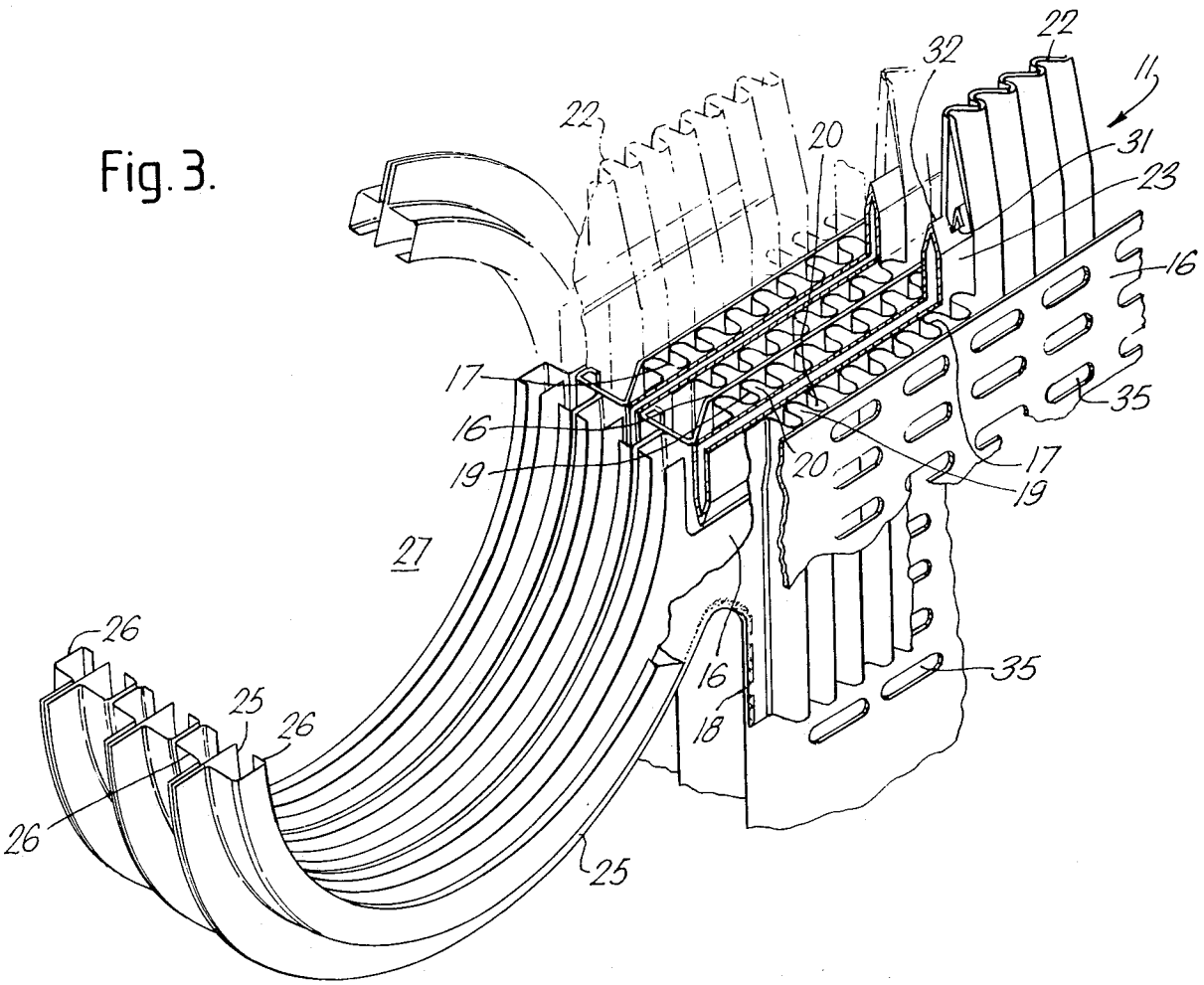
FIG. 3 is a partially broken away perspective view of the heat exchanger shown in FIGS. 1 and 2.

The internal structure of the heat exchanger matrix 11 can be seen more clearly if reference is made to FIG. 3. The matrix 11 essentially comprises a stack of alternate layers of planar sheet metal 16 and corrugated sheet metal 17, the layers 17 being so arranged that all of their corrugations are parallel. Over the majority of their abutting surfaces, there is no form of bonding between the planar and corrugated sheets 16 and 17. In fact the only bonding between the planar and corrugated sheets 16 and 17 is constituted by brazed joints, one of which 18 can be seen in FIG. 3 along those portions of the matrix 11 periphery which lie parallel with the corrugations in the corrugated sheet material 17.

The advantage of the lack of any major bonding between the planar and corrugated sheet material 16 and 17 is that the whole matrix 11 is less prone to damage, such as cracking, arising from thermal gradients occurring within it.

The planar sheets 16 and corrugated sheets 17 cooperate to define a large number of parallel passages 19 and 20 within the matrix 11. The passages 19 are open to the second heat exchange fluid flow as indicated by the arrows 15. Thus the second heat exchange fluid flows into the heat exchanger matrix 15 in the direction indicated by the arrows 15, through the passages 19 and exhausts from the matrix 11 in the direction indicated by the arrows 21.

The passages 20 alternate with the passages 19 for a given corrugated sheet 17 and the adjacent planar sheets 16 which cooperate with it. The passages 20 are intended for the passage therethrough of the first heat exchange fluid and so it will be seen therefore that the first and second heat exchanger fluids are on opposite sides of each of the corrugated sheets 17 in effective contraflow heat exchange relationship with each other.

In order to ensure, that the first and second heat exchange fluids do not come into physical contact with each other, adjacent pairs of the corrugated sheets 17 converge at each of their flow extents and are bonded together by a suitable braze joint 22 as can be seen in FIG. 3. Thus each pair of corrugated sheets 17 encloses a plurality of first heat exchange fluid passages 20 which are totally separate from the second heat exchange fluid passages 19.

Figure 4:
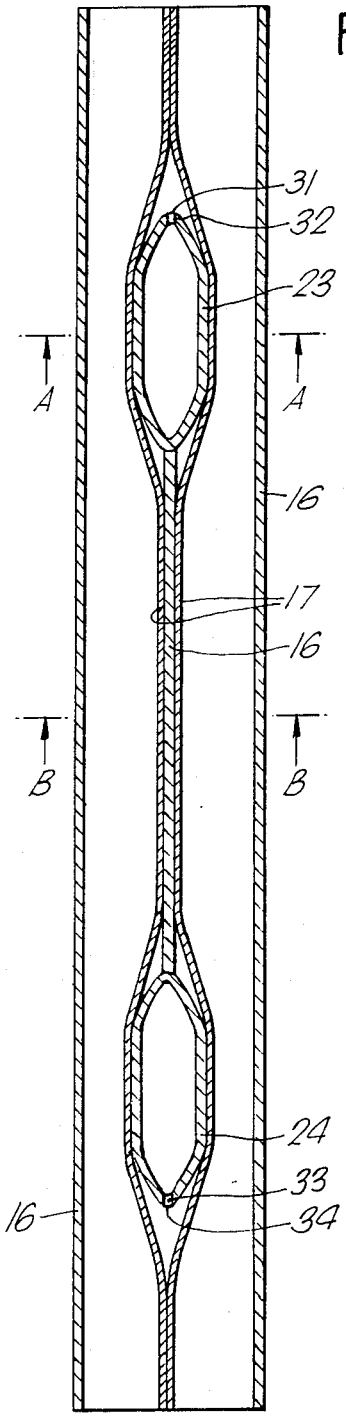
FIG. 4 is a sectioned side view of a portion of the matrix of the heat exchanger shown in FIGS. 1 to 3.

The first heat exchange fluid is introduced into the passages 20 enclosed by each pair of corrugated sheets 17 by means of a first manifold 23. Each manifold 23 is, as can be seen in FIGS. 3 and 4, of hexagonal cross-sectional shape and is interposed between each pair of the corrugated sheets 17 adjacent one of their flow extents. In order to accommodate each manifold 23, each alternate planar sheet 16 is arranged to be shorter than the pair of corrugated sheets 17 which are adjacent to it. Moreover the corrugations in each pair of corrugated sheets 17 are arranged to be of smaller amplitude in the regions of the manifold 23 than in the remainder thereof. This can be seen more clearly if particular reference is made to FIGS. 4,5 and 6. It will also be noted from FIG. 4 that a second manifold 24 for the exhaustion of the first heat exchange fluid from the passages 20 is enclosed by the same pair of corrugated sheets 17 which enclose the first manifold 23. The second manifold 24 is of the same configuration and is enclosed by the pair corrugated sheets 17 in the same manner as the first manifold 23.

As previously stated, each alternate planar sheet 16 is arranged to be shorter than the pair of corrugated sheets 17. In fact, as can be seen from FIG. 4 each of the extents of the shorter planar sheets 16 abuts one of the first and second manifolds 23 and 24.

A further feature of each of the shorter planar sheets 16 can be seen if reference is now made to FIG. 3. There it will be, seen that immediately adjacent each of the first manifolds 23, each of the shorter planar sheets is provided with an integral ring-shaped extension piece 25 which protrudes beyond the heat exchanger matrix 11. Each of the extension pieces 25 is in turn interposed between and bonded to a pair of ring shaped, outwardly joggled cross-section members 26 which can be integral with, or bonded to the edges of corrugated sheets 17.

Adjacent joggled cross-section ring members 26 are bonded to each other so that the members 26 and the extension pieces 25 cooperate to define a duct 27. A blanking plate 28 seals one end of the duct 27 while the first heat exchanger fluid inlet conduit 13 is in flow communication with the other end as can be seen in FIG. 1.

Additional extension pieces 25 and joggled cross-section members 26 define a second duct 29 similar to the first duct 27 which is situated externally of the matrix 11 adjacent the second manifolds 24. A blanking plate 30 seals one end of the duct 29 while the other end is in flow communication with the first heat exchanger fluid outlet conduit 14.

Figure 5:
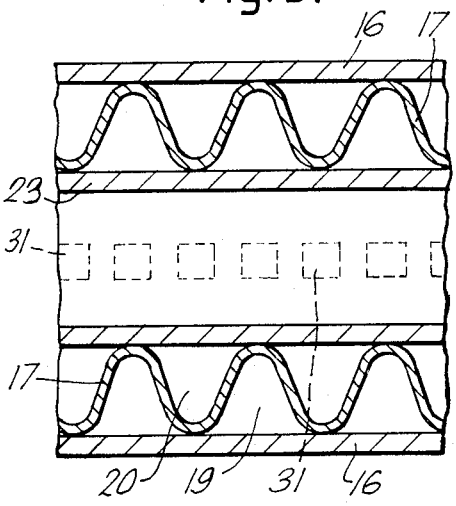
FIG. 5 is a view on section line A—A of FIG. 4.
Figure 6:
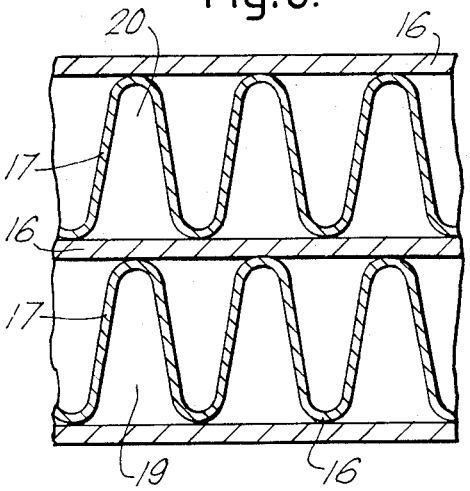
FIG. 6 is a view on section line B—B of FIG. 4.

Each of the first and second manifolds 23 and 24 is in flow communication with the interior of the first and second ducts 27 and 29 respectively. Thus the first heat exchange fluid operationally flows through the conduit 13 and into the first duct 27 from whence it flows into the first manifolds 23. Each of the first manifolds 23 is provided with a plurality of apertures 31 (as can be seen in FIGS. 3 and 4) which are so positioned as to direct the first heat exchange fluid into the matrix passages 20. Thus each aperture 31 is positioned on the outermost edge 32 of the first manifold 23 so as to direct the first heat exchanger fluid into one of the passages 20. As can be seen in FIG. 5, the apertures 31 direct the first heat exchange fluid into passages 20 defined on each side of the manifold 23 separating them.

The second manifolds 24 are provided with a plurality of apertures 33 on their outermost edges 34 (as can be seen in FIG. 4) which correspond with the apertures 31 in the first manifolds 23. Thus each of the apertures 33 in the second manifolds 24 is so positioned as to receive the first heat exchange fluid which has passed one of the passages 20. The second manifolds 24 then direct the first heat exchange fluid, which of course has now been in heat exchange relationship with the second heat exchange fluid passing through the passages 19, into the second duct 29 from whence it flows into the conduit 14.

In order to cater to any variations in pressure between adjacent passages 19 and adjacent passages 20, each of the planar sheets 16 is, as can be seen in FIG. 3, provided with a large number of elongate apertures 35. The apertures 35 bridge each of adjacent passages 19 and adjacent passages 20 as to permit a cross-flow of first heat exchange fluid between adjacent passages 20 and a cross-flow of the second heat exchange fluid between adjacent passages 19, thereby providing appropriate pressure equalization.

Thus each module 12 comprises two of the corrugated sheets 17, two planar sheets 16, two manifolds 23 and 24 together with the structure necessary to define portions of the ducts 27 and 29. It is a simple matter therefore to build up an appropriate number of modules 12 until a heat exchanger of the desired size is achieved. It should be noted that the braze joints 18 holding each module 12 together are external of the module 12, and hence the matrix 11.

It will be seen therefore that heat exchangers in accordance with the present invention provide effective contra-flow heat exchange between first and second heat exchange fluids within very compact dimensions. Moreover the modular form of construction of the heat exchangers means that an appropriate capacity heat exchanger can be easily built up by stacking together an appropriate number of modules 12.

A further attraction of heat exchangers in accordance with the present invention is that the fact that the only braze joints 18 in the heat exchanger are external thereof and therefore readily accessible for repair purposes. Thus if an internal failure of the matrix 11 should occur, only the external braze bonds 18 need be broken to gain access to the matrix 11 interior. The lack of internal bonding within the matrix 11 also ensures that limited relative movement is possible between the various components within the matrix 11, thereby making the matrix very resistant to damage as a result of large thermal gradients.

We claim:

1. A heat exchanger comprising a matrix defined by a stack of alternate layers of generally planar sheet material and sheet material of generally corrugated form which cooperate to define a plurality of generally parallel passages, alternate of said passages defined by each of said generally corrugated sheets and its adjacent generally planar sheets being adapted for the passage of a first heat exchange fluid therethrough, the remainder of said passages being adapted for the passage of a second heat exchange fluid therethrough, said passages for the passage of said first heat exchange fluid being so adapted as to prevent any physical contact between said first and second heat exchange fluids, first manifold means being provided and so adapted as to operationally direct said first heat exchanger fluid into each of said passages adapted for the passage of said first heat exchange fluid therethrough and second manifold means being provided and so adapted as to operationally exhaust said first heat exchange fluid from each of said passages adapted for the passage of said first heat exchanger fluid therethrough, said generally corrugated sheets being longer in the direction of said passages than alternate of said generally planar sheets, each of said first and second manifold means being positioned adjacent the ends of the shorter of said generally planar sheets and interposed between adjacent of said generally corrugated sheets so as to be in contact therewith, the amplitude of the corrugations in said generally corrugated sheets being reduced in the vicinity of said manifolds to facilitate the accommodation of said manifolds.

2. A heat exchanger as claimed in claim 1 wherein said reduced amplitude portions of said adjacent generally corrugated sheets extend beyond said first and second manifold means to converge and sealingly engage each other to provide said prevention of physical contact between said first and second heat exchange fluids.

3. A heat exchanger as claimed in claim 1 wherein said sheets of generally planar and generally corrugated material are bonded together only along those portions of the peripheries of said generally corrugated sheets which are generally parallel with said so defined passages.

4. A heat exchanger as claimed in claim 1 wherein each of said first and second manifolds is respectively adapted to direct said first heat exchange fluid into said passages adapted for the passage of said first heat exchange fluid therethrough and exhaust said first heat exchange fluid therefrom in directions which are generally opposite to the flow direction of said second heat exchange fluid through said passages adapted for the passage of said second heat exchange fluid therethrough.

5. A heat exchanger as claimed in claim 1 wherein each of said first and second manifolds is provided with a plurality of apertures for respectively directing said first heat exchange fluid into and exhausting said first heat exchange fluid from said passages adapted for the passage of said first heat exchange fluid therethrough, each of said apertures being so positioned as to be in flow communication with one of said passages adapted for the passage of said first heat exchange fluid therethrough.

6. A heat exchanger as claimed in claim 1 wherein each of said generally planar sheets is provided with slots therein which permits the cross-flow of said second heat exchange fluid between said passages adapted for the passage of said second heat exchange fluid.

7. A heat exchanger as claimed in claim 1 wherein first and second duct means are provided at each extent of said heat exchanger matrix, said first duct means being in flow communication with said first manifold means and adapted to receive said first heat exchange fluid and direct said first heat exchange fluid into said first manifold means, said second duct means being in flow communication with said second manifold means and adapted to receive said first heat exchange fluid exhausted from said second manifold means.

8. A heat exchanger as claimed in claim 7 wherein said first and second duct means are at least partially formed from portions of said generally planar sheets extending beyond the regions of abutment between said generally planar sheets and said generally corrugated sheets.

9. A heat exchanger as claimed in claim 1 wherein said matrix includes a plurality of said first manifold means and a plurality of said second manifold means.

* * * * *